US005581812A

United States Patent [19]

Krocheski

[11] Patent Number: 5,581,812

[45] Date of Patent: Dec. 10, 1996

[54] LEAK-PROOF TEXTILE GLOVE

[75] Inventor: Joseph Krocheski, Tolland, Conn.

[73] Assignee: Comasec Safety, Inc., Enfield, Conn.

[21] Appl. No.: 276,717

[22] Filed: Jul. 18, 1994

[51] Int. Cl.[6] ..... A41D 19/00

[52] U.S. Cl. ..... 2/167; 2/161.6; 2/169

[58] Field of Search ..... 2/167, 168, 161.6, 2/164, 159, 161.7, 169

[56] References Cited

U.S. PATENT DOCUMENTS

| | | | |
|---|---|---|---|
| 1,157,646 | 10/1915 | Miller | 2/168 |
| 1,769,977 | 7/1930 | Watkins | 2/168 |
| 2,004,382 | 6/1935 | Palicki | 2/164 |
| 2,561,891 | 7/1951 | Tucker | 2/167 |
| 2,578,188 | 12/1951 | Ionides et al. | 2/167 |
| 2,916,036 | 12/1959 | Sutton | 2/167 |
| 3,363,265 | 1/1968 | Dunmire | 2/167 |
| 4,342,121 | 8/1982 | Vistins | 2/164 |
| 4,359,783 | 11/1982 | Andrews | 2/164 |
| 4,430,759 | 2/1984 | Jackrel | 2/167 |
| 4,519,098 | 5/1985 | Dunmire et al. | 2/164 |
| 4,555,813 | 12/1985 | Johnson | 2/168 |
| 4,569,707 | 2/1986 | Johnson | 2/167 |
| 4,679,257 | 7/1987 | Town | 2/164 |
| 4,742,578 | 5/1988 | Seid | 2/167 |
| 4,902,283 | 2/1990 | Rojko et al. | 2/167 |
| 4,918,754 | 4/1990 | Leatherman et al. | 2/167 |
| 5,070,540 | 12/1991 | Bettcher et al. | 2/167 |
| 5,113,532 | 5/1992 | Sutton | 2/167 |

*Primary Examiner*—Amy B. Vanatta
*Attorney, Agent, or Firm*—Chilton, Alix & Van Kirk

[57] ABSTRACT

A leak proof materials handling glove that comprises a textile outer layer shaped to fit a hand. The outer layer is of a cut resistant material with good gripping ability on oily metal machine parts, preferably terry cloth cotton. The outer layer defines an interior and exterior surface. A liquid impermeable inner layer of a polymeric material impervious to attack from petroleum based products, such as PVC, is bonded to substantially the entire interior surface of the outer layer. The inner layer forms a continuous liquid-impermeable barrier to machine tool cutting fluids, protecting a wearer's hands from contact with the fluids.

21 Claims, 2 Drawing Sheets

LEAK-PROOF TEXTILE GLOVE

BACKGROUND OF THE INVENTION

The present invention is directed to a glove worn by workers to handle oil coated metal parts. These metal parts typically have smooth oily surfaces that are difficult to grasp. It is desirable to reduce contact between the worker's skin and the oil or cutting fluids that result from machining or forming processes. In addition, the metal parts may have sharp burrs that can injure workers.

Presently, available gloves for the handling of oily metal parts are made of cotton or leather, which are well known for cut resistance and gripping ability of smooth, oily surfaces. These gloves have the undesirable trait of allowing oil and cutting fluids to soak through the glove and come in contact with the worker's hands. The oil-soaked glove in contact with the hand, actually exacerbates the potential risk for dermatitis.

SUMMARY OF THE INVENTION

The primary object of the present invention is to provide gloves which promote efficient handling of metal parts coated with oils and cutting fluids while not allowing the worker's hands to come in contact with the oils and fluids.

It is a further objective of the invention that worker's hands be protected from sharp edges and burrs on oily metal parts.

It is yet another object of the invention to provide workers with a materials handling glove that satisfies the preceding objects, and which can be easily donned and doffed.

In fulfillment these and other objectives, the materials handling glove of this invention comprises a series of layers that are preferably fabricated according to a novel method.

A hand shaped outer layer defines an interior surface for receiving the user's hand and an exterior surface, preferably cut-resistant, for gripping materials. The interior surface is provided with another layer defining a lining of a flexible continuous material that is leak proof. This lining extends over the entire interior surface of the glove and is bonded substantially coextensively everywhere on the interior surface. The result is a glove comprising multiple layers. The outer layer performs the functions of efficiently grabbing oily or fluid contaminated machined parts as well as protecting both the wearer and the liquid proof inner layer from cuts. The inner layer performs the function of preventing the oils or cutting fluids from penetrating the glove and coming into contact with the wearer's hands. Additional inner layers may be included inside the glove to aid in the insertion and removal of the wearer's hands from the glove.

The glove is preferably manufactured by placing a cotton layer shaped to fit a hand onto a hand shaped form. The form with the cotton layer is then dipped into a vat of a polymeric, liquid material. The liquid material is fused or vulcanized to form the liquid proof layer. The resulting glove is removed from the form and turned inside out for proper use.

BRIEF DESCRIPTION OF THE DRAWINGS

The invention will be more readily understood with reference with the accompanying drawings wherein.

DETAILED DESCRIPTION OF THE INVENTION

Figure 1:
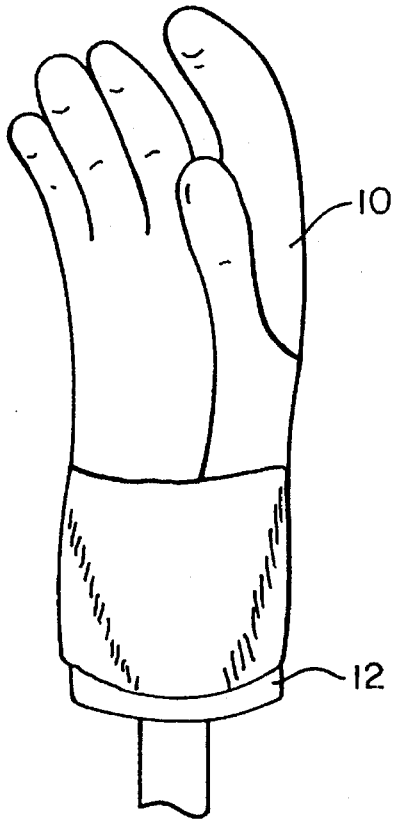
FIG. 1 is a view of the cotton layer of the materials handling glove.

FIG. 1 is an elevation view of an outer layer 10 of a materials handling glove for gripping oily or fluid covered metal parts. The preferred material of the outer layer is a cotton, but, other textiles made from synthetic fibers such as aramids, or a combination of synthetic fibers and metal mesh, can be used if cut resistance is especially important. Cotton is preferred because of its known gripping and absorbency qualities on oily metal surfaces. To increase the cut resistance of the glove, the cotton could be in the form of a knit terry cloth with the loops positioned on the outside. The outer layer 10 disclosed is of the preferred form, that of a glove shape with individual fingers. It is recognized that the invention could also be formed of any hand covering shape, such as a mitten.

The method of producing the inventive glove begins with the step of assuring that the outer layer 10 is supported with the looped side to the interior. The glove 10 need not necessarily have a looped side (i.e., it could be the same on both sides). However, in the case of the terry cloth outer layer it is important that the liquid impermeable layer be applied to the side of the fabric opposite the terry cloth loops. The outer layer is shown supported on a hand shaped form 12. The form maintains the shape of the outer layer during the steps that follow.

Figure 2:
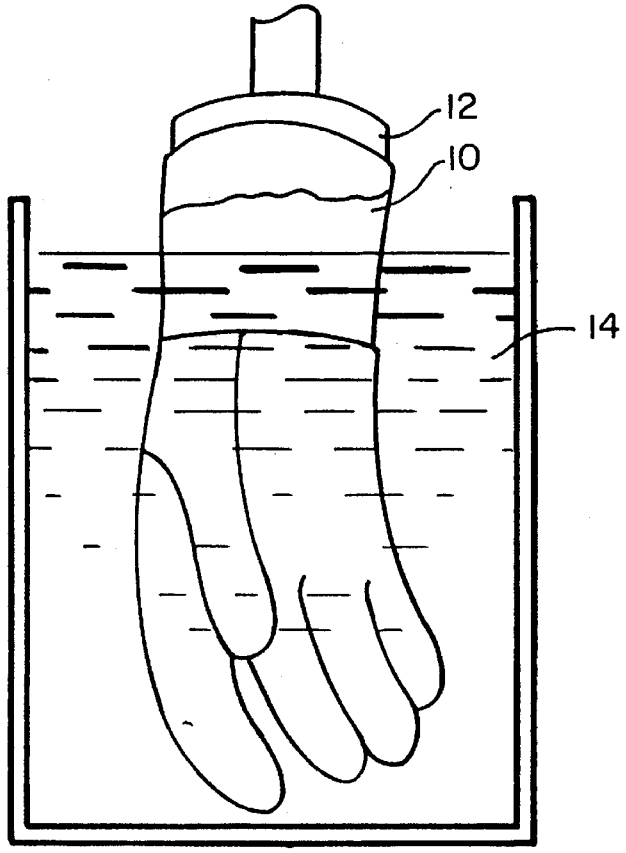
FIG. 2 is a schematic representation of the application of a liquid impermeable layer to the cotton layer.

FIG. 2 discloses the application of the liquid impermeable layer to the outer layer. The outer layer 10 on the form 12 is dipped into a vat of a fluid 14 of the desired impermeable layer. In the preferred embodiment, this fluid is PVC. Other materials that can provide flexible, liquid impermeable layers include polyurethane, natural rubber or latex. The liquid impermeable layer needs to be sufficiently flexible for the wearer of the glove to have good manipulation. Moreover, this protective layer is preferably resistant to attack from petroleum based fluids. After the glove has been dipped (or sprayed or foamed) with the fluid form of the liquid impermeable layer, the outer layer as coated on the form is removed from the vat and the coating is cured. Curing of PVC is achieved by heating until it fuses, whereas latex would be cured by vulcanization.

When the liquid impermeable layer has sufficiently cured, the glove is removed from the form and turned inside-out (inverted). The glove then comprises two layers which are bonded, i.e., an outer layer 10, preferably of cotton, to provide a superior surface for the handling of oily or fluid contaminated metal parts, and an inner layer of the cured but flexible liquid proof material 14 to protect the worker's hands from contamination by the fluids.

Figure 3:
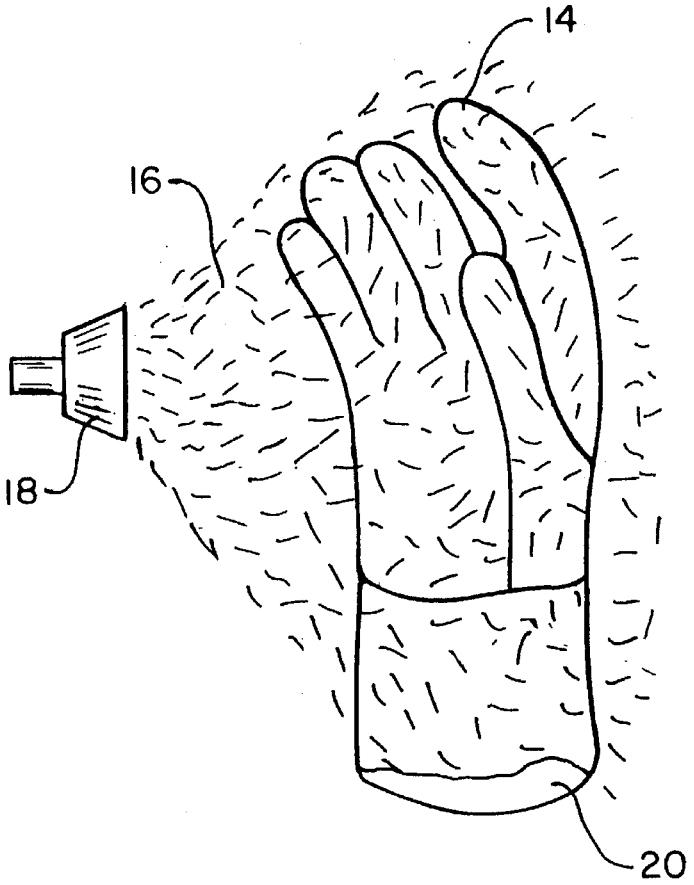
FIG. 3 is a schematic representation of the optional application of a third layer of lining material to the glove.

FIG. 3 discloses the additional step of spraying a flocking material onto the glove 20. After the liquid impermeable layer 14 has been applied, but before the entire glove has been inverted, the flocking material 16, is sprayed from sprayer 18 to coat the surface of the glove. The preferred material for the flocking 16 are cotton fibers. When the glove is inverted the flocking material 16 will be on the inside and thus aid the wearer of the glove in donning and doffing the glove because of the reduction in friction as a result of the flocking.

Figure 4:
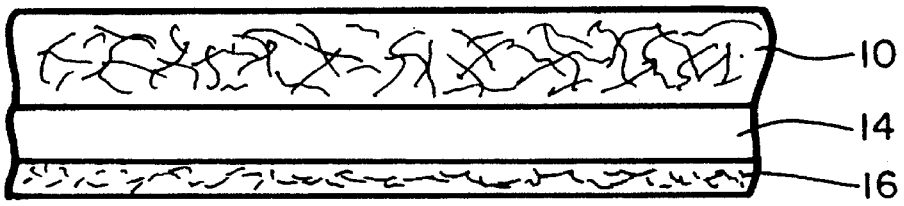
FIG. 4 is a cross-sectional view of the glove after completion of step shown in FIG. 3.

FIG. 4 is a cross-sectional view of the preferred embodiment of the glove. The outer layer 10 of the glove is of the preferred types of material to facilitate the handling of oily metal parts. The liquid impermeable layer 14 is a continuous surface bonded to substantially the entire inner surface of this outer layer 10. This bonding allows the wearer of the glove to retain sufficient control over handled material that would not be possible if the two layers were not bonded together and could move relative to each other. The additional layer of the flocking 16 is on the surface of the liquid impermeable layer opposite that of the outer layer 10. This in the preferred embodiment will be the material closest to the wearer's skin. As used herein, the term "liquid impermeable" should be understood as synonymous with "leak proof" or the like, i.e., satisfying the criteria set forth in ASTM-D5151-92.

The advantage of the present invention is the combination of a textile outer surface with a continuous, liquid proof layer that is bonded as an integral film without an adhesive or attachment means to the entire inner surface of the glove. As a result, there are no places where a liquid could penetrate the glove and reach the wearer's hands. Without the continuity of the liquid proof layer, oils and cutting fluids would eventually reach the wearer's hands, thereby defeating the purpose of the invention. Additionally, the continuous bond allows the wearer good manipulation of parts which would not be possible if the outer layer and the liquid proof layer could move relative to one another. A highly textured outer surface such as terry cloth loops or metal mesh, also serves to protect the integrity of the liquid resistant layer.

I claim:

1. A leak-proof materials handling glove comprising:

a textile outer layer defining an interior surface and an exterior surface, each of said surfaces shaped to cover an entire hand; and a seam-free liquid impermeable layer, said impermeable layer bonded by direct adhesion to the entire interior surface of said outer layer, to form a continuous liquid impermeable barrier shaped to cover an entire hand.

2. The leak-proof glove of claim 1 wherein the outer layer is comprised of knit cotton.

3. The leak-proof glove of claim 1 wherein the liquid impermeable layer is lined with flock.

4. The leak-proof glove of claim 1, wherein the outer layer is comprised of cotton terry cloth.

5. The leak-proof glove of claim 4, wherein the liquid impermeable layer is a polymeric material.

6. The leak-proof glove of claim 5 wherein the liquid impermeable layer is comprised of PVC.

7. The leak-proof glove of claim 5 wherein the liquid impermeable layer is comprised of latex.

8. The leak-proof glove of claim 5, wherein the liquid impermeable layer is comprised of polyurethane.

9. The leak-proof glove of claim 1, wherein the outer layer is comprised of aramid fibers.

10. The leak-proof glove of claim 1, wherein the outer layer includes metal mesh material.

11. The leak-proof glove of claim 1, wherein the liquid impermeable layer is polymeric.

12. The leak-proof glove of claim 11, wherein the polymeric material is a film bonded to said interior surface without intervening adhesive material.

13. The leak-proof glove of claim 11, wherein the polymeric material is a foam bonded to said interior surface without intervening adhesive material.

14. The leak-proof glove of claim 1, wherein the liquid impermeable layer is resistant to attack by petroleum based liquids.

15. The leak-proof glove of claim 1, wherein the liquid impermeable layer is comprised of natural rubber.

16. A method of manufacturing a leak-proof materials handling glove, comprising:

supporting a textured textile layer in the shape of a glove which thereby defines an outer surface and an inner textured surface, each having said shape;

coating all of said outer surface of the supported textile layer with a liquid impermeable material to form a continuous film integrally adhered without adhesive to said textile layer; and inverting the coated textile layer to form a finished materials handling glove having a textured textile exterior surface in the shape of a glove and a continuously coated interior surface in the shape of a glove.

17. The method of claim 16, further comprising the step of depositing flocking on the coating of the textile layer, before the step of inverting.

18. The method of claim 16, wherein the step of coating includes depositing a layer of polymeric material and then curing the deposited material.

19. The method of claim 18 wherein the liquid impermeable material is comprised of PVC.

20. The method of claim 18 wherein the liquid impermeable material is comprised of latex.

21. The method of claim 18 wherein the textile layer is knit cotton.

* * * * *